United States Patent [19]

Benedek et al.

[11] 4,135,667

[45] Jan. 23, 1979

[54] APPARATUS FOR THE ELECTROSTATIC COATING OF WORKPIECES

[75] Inventors: György Benedek; Pëter Hornung, both of Budapest, Hungary

[73] Assignee: Hajtömüvek és Festöberendezësek Gyara, Budapest, Hungary

[21] Appl. No.: 780,472

[22] Filed: Mar. 23, 1977

[51] Int. Cl.[2] ..... B05B 5/02

[52] U.S. Cl. ..... 239/697; 239/707

[58] Field of Search ..... 118/629–635; 239/15; 361/327, 328, 329; 427/21, 27–30, 32, 33

[56] References Cited

U.S. PATENT DOCUMENTS

| | | | |
|---|---|---|---|
| 3,521,125 | 7/1970 | Nelson | 239/15 X |
| 3,659,151 | 4/1972 | Fabre | 361/227 |
| 3,673,463 | 6/1972 | Gourdine | 361/227 |
| 3,745,413 | 7/1973 | Whitmore | 361/229 |
| 3,895,261 | 7/1975 | Merkind et al. | 361/227 |
| 4,020,393 | 4/1977 | Porter | 361/227 |
| 4,039,145 | 8/1977 | Felici et al. | 239/15 |

*Primary Examiner*—Morris Kaplan

[57] ABSTRACT

An electrostatic spray apparatus wherein a charging chamber is formed as an enlargement in the conduit feed to the spray nozzle. The charging electrode is disposed axially of the conduit with a pointed end located at the exit end of the enlargement and facing upstream of a particle stream flow and opposed to a counterelectrode end located at the inlet side of said enlargement. The counterelectrode may be an obtuse end of an elongated element or may be formed as a grid extending across the conduit or as an annular element formed about a wall of the conduit. Optionally shown are a plurality of enlarged charging chambers, as annular element forming a constricted flow path and a charging electrode second end extending beyond the spray nozzle. Means introduce an air flow into the particle stream at both the nozzle and at the charging chamber.

13 Claims, 9 Drawing Figures

APPARATUS FOR THE ELECTROSTATIC COATING OF WORKPIECES

BACKGROUND OF THE INVENTION

Figure 1:
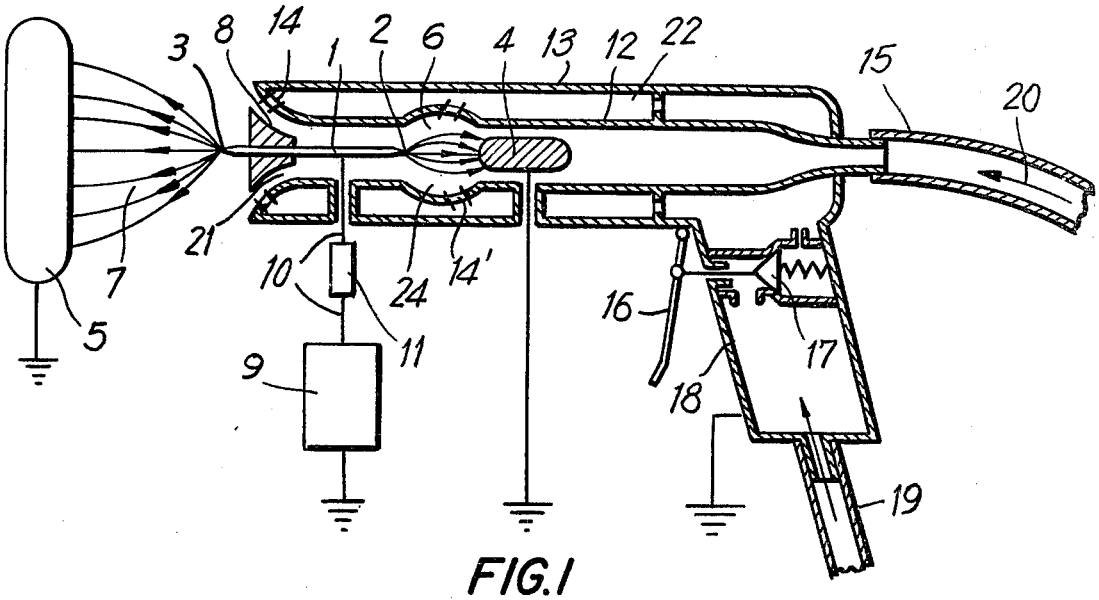

The invention concerns an apparatus for the electrostatic coating of workpieces by the application or spraying of material particles such as powders, fibrous materials and/or paints.

Various devices are known that are suitable for the electrostatic application of pulverulent and fibrous materials and paints. These electrostatic coating devices can be classified into three main groups according to their physical system of charging.

In the first group belong devices with charging electrodes coupled to a very high voltage, 50 to 150 kV. The radius of curvature of this electrode is chosen to be very small (needle point, knife edge) so that the air particles in the vicinity thereof are ionized by the ionizing effect of the electrode (corona discharge), and the fine particles of the material to be sprayed or applied entrain the ionized air particles and thus themselves acquire a charge. The force field formed between the electrode, connected to one pole of a high tension DC source (the other pole of which is grounded) and the object (which is also grounded) to be coated with paint, pulverulent or fibrous material, causes the flow of the charged particles to be directed towards the grounded object.

A disadvantage of these devices is the requirement of relatively high electrical voltages the production of which is complicated and requires expensive voltage sources. In addition, the metallic electrode projects freely and thus presents an increased risk of sparking and fire. Furthermore, it is disadvantageous that the ion wind formed by the ionization of air is harmful to health and can also charge objects disposed in the vicinity of the apparatus, thereby causing unpleasant electrical shocks on touch, as well as presenting a risk of sparking and fire. The non-uniform distribution of charge of the sprayed or scattered particles is a further drawback.

The devices belonging to the second group have, in addition to the high tension electrode for charging, a grounded auxiliary electrode. While flowing through the apparatus, the material to be sprayed passes in contact with the high tension electrode and takes the charge from the intensive field produced by tha auxiliary electrode. This process is to be regarded as modern and progressive in that no outer electrode is used and the operational voltage is relatively low, 20 to 30 kV. However, the scope of utilization is rather limited in that the efficiency is relatively low for materials that are difficult to charge, and have a relatively high specific resistance, principally pulverulent materials.

The devices belonging to the third group have no high tension electrode. The material to be sprayed or applied obtains its charge by frictional electricity; accordingly a high electric potential produced by a particular source of voltage is not required. However, it is a disadvantage that this process is only effective for pulverulent substances, and because of the absence of a high voltage electrode and the force field produced thereby, efficiency is in general lower than the efficiency of the electrode systems.

From German published application No. 1,953,989 a spraying apparatus is known wherein the paint particles are conveyed at least partly in opposition to the ion wind which is produced externally by a pointed charging electrode in front of the mouth of an outlet diffuser, and wherein the charging electrode is arranged at the height of the longitudinal axis of the paint stream and is directed towards the mouth of the spray head. A blunt counterelectrode is constituted by a nozzle ring surrounding the outlet opening. Both electrode arrangements are surrounded by an insulated tube. Since the corona discharge directed to the outlet opening forms a high concentration of atmospheric ions which intersect the stream of atomized paint particles in a direction opposed to that of the movement of the particles, a high charge is transmitted to the paint particles. This known apparatus is, however, provided mainly for liquid paints. Also, in this apparatus the efficiency for materials with higher specific resistance, such as in particular pulverulent materials is still low.

THE INVENTION

In contrast, the present invention seeks to solve the task of providing apparatus for the electrostatic coating or spraying of material particles, such as pulverulent materials, fibres and/or paints, wherein the material particles to be applied receive a more intensive and more uniform charge despite the use of a lower charging tension.

This is attained according to the invention with an apparatus for the electrostatic coating or spraying of a workpiece by material particles such as pulverulent materials, fibrous materials and/or paints, comprising a feed channel for the material particles, which terminates in an outlet, a pointed charging electrode and a counterelectrode cooperating with the charging electrode to charge the material particles, the charging electrode and counterelectrode being connected in use to opposite polarities of a high tension power source, the counterelectrode being upstream, relative to the direction of flow of the material particles, of the charging electrode, the pointed end of which is directed towards the counterelectrode, the charging electrode and the counterelectrode being arranged in the interior of the feed channel, upstream of the said, outlet in a charging space or chamber formed in the feed channel and bounded by wall(s) of insulating material.

With the inventive apparatus, qualitatively better coatings may be obtained, in relation to the state of the art, and at the same time one operates with lower voltages. The charging chamber or space embodied in the invention is disposed in the interior of the feed channel, and the material particles are charged in counterflow to the direction of ion flow; moreover, the material particles to be charged are collected in the region of the electrodes in the feed channel and are conveyed such that the charging is very intensive and uniform. After passing the downstreamly disposed pointed charging electrode, the material particles are then led in the same direction as the ion stream in the force field, between the spray gun and the object to be coated, and which is connected to a polarity opposite to that of the charging electrode.

It is known in paint spraying guns, see e.g. Swiss Patent No. 521,173, to provide in the direction of flow a pair of spaced apart and cooperating electrode pairs in the interior of the spraying head, upstream of the outlet opening. However, here the electrodes are disposed in a widening part of the outlet diffuser itself. In addition, the electrodes are not connected to opposite polarities so that they do not constitute a pair made up of a charging electrode and a counterelectrode. Rather, in this known case there are in fact two charging electrodes which cooperate with the workpiece, functioning as a counterelectrode. Accordingly, the electrodes are aligned with the workpiece so that there is no provision in this case for guiding of the paint stream in countercurrent to the ion wind.

The particles for coating that have been uniformly and very intensely charged, in use of this invention, deposit themselves on the workpiece either directly, by virtue of their own charge, or additional charging may be used in the form of an external force field between the charging electrode and the workpiece so as to increase the energy of the particles through the effect of this outer force field.

In addition, a further advantage arises with the invention, namely that the arrangement of the electrodes in the interior of the feed channel represents an increased safety feature, because in addition to the low charging voltage made possible thereby, neither electrode is disposed freely on the outside of the apparatus so that no risk of touching, sparking or fire arises and furthermore, the ion wind formed by ionization of the air is produced within the apparatus in a protected manner. By means of the apparatus according to the invention considerably lower voltages, 40–60 kV, can be used to provide a satisfactory surface coating both with pulverulent and fibrous materials.

The degree of charging of the material particles achieved by practicing the invention can be made even more intensive and uniform by means of a modified embodiment of the invention wherein the charging chamber or space has a widened portion downstream of and next to the counterelectrode. In this way the materials entering the electric field in the charging space at high speed are braked, whereby to improve the intensity of charging.

According to a further embodiment of the invention this can be made more favourable still by narrowing the charging chamber or space downstream of the widened portion and positioning the tip of the charging electrode in this narrowed portion. In this way the material particles are subjected to a considerable acceleration after leaving the electric field.

Further it is expedient to extend the charging electrode in the direction of flow beyond the outlet diffuser so that it terminates in a tip or point. In this way an additional strong force field can be created between the externally located tip or point of the charging electrode and the object to be coated so that the charged material particles are here further accelerated.

In a further development of the invention the internal force field may be made up of a plurality of serially connected charging spaces. In this case the length of the force field is increased to achieve even more intensive charging.

In other exemplary embodiments of the invention the counterelectrode may be a metallic grid, but preferably it is formed as an annular electrode or as one or more central electrodes, approximately in the middle of the feed channel, and which are preferably rounded and/or streamlined.

By the use of a central electrode the free cross-section of the feed channel is narrowed in the manner of a nozzle. This can, however, also be arranged by a suitable construction of the annular electrode projecting into the feed channel with a rounded periphery. The resulting constriction results in the conveyed material particles first receiving a high velocity, then being strongly braked in the charging space adjacent thereto which has a widened portion.

In the most simple solution, leading to corresponding manufacturing advantages, the counterelectrode can be a cylindrical pipe connected to the ground pole of the grounded metallic housing of the apparatus and formed at the inlet end of the feed channel, and may be provided with bores for introducing the air-borne particles of the coating material.

Preferably, the feed channel is located coaxially within an annular air flow path terminating in an air outlet adjacent to the outlet of the material particles; additionally or alternatively, the feed channel may be provided with nozzle means disposed to direct air or another suitable fluid into the feed channel upstream of its outlet, preferably into the or into each charging space or chamber.

The advantage of the invention consists particularly in that pulverulent materials, fibrous materials as well as paints can be applied and coated with a considerably lower energy than is the case with hitherto known apparatuses.

Figure 2:
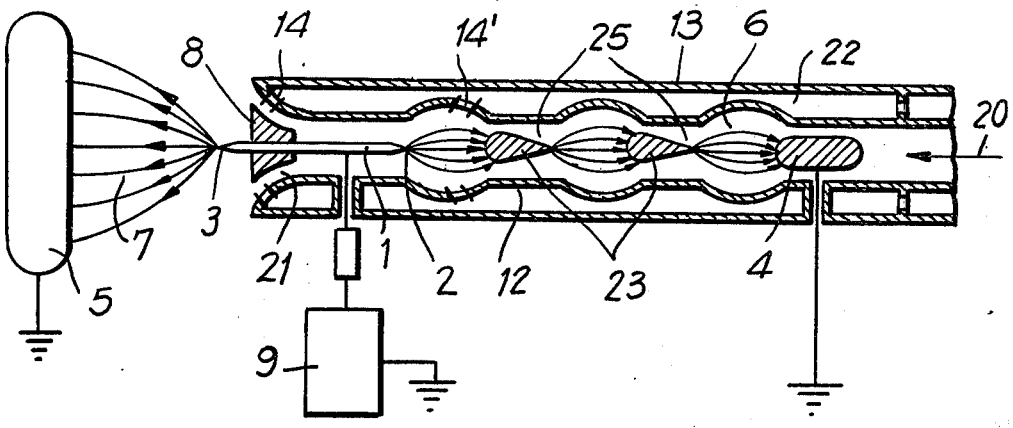
Figure 3:
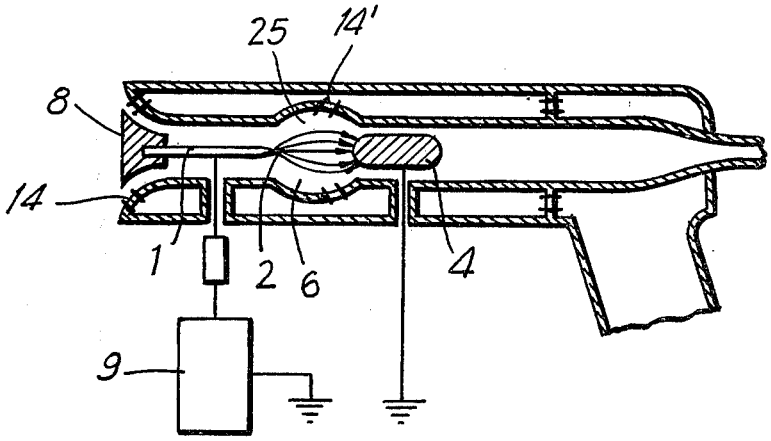
Figure 4:
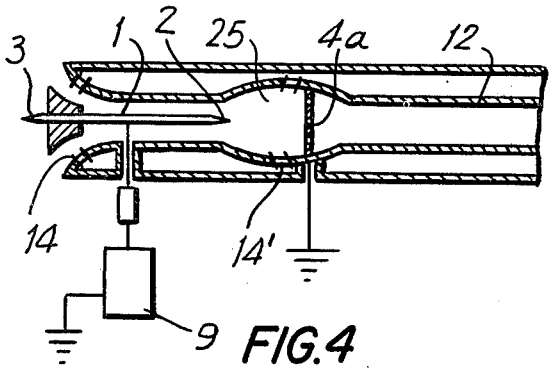
Figure 7:
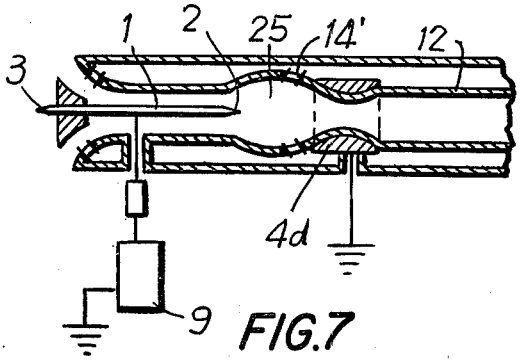
Figure 5:
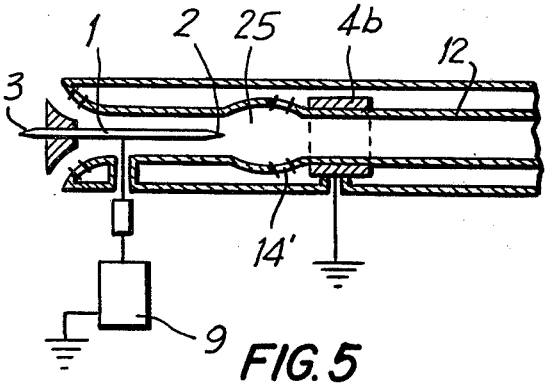
Figure 8:
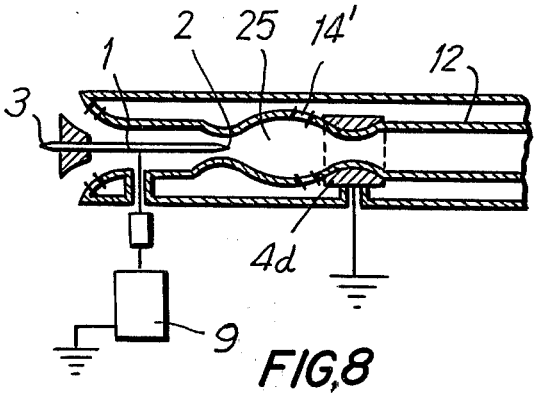
Figure 6:
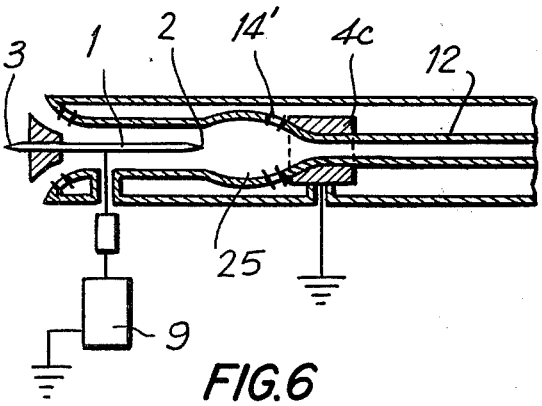
Figure 9:
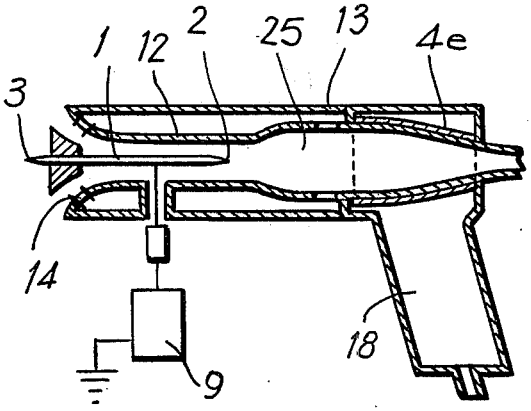

The invention will be described, by way of example, with reference to the accompanying schematic drawings illustrating preferred, exemplary embodiments, wherein:

FIG. 1 is a spray gun shown in cross-section and embodying apparatus an exemplary according to the invention, FIG. 2 shows the arrangement in principle of a further embodiment of the apparatus with a plurality of asymmetrical force fields, FIG. 3 shows, in longitudinal section, the arrangement in principle of a third embodiment of the apparatus with only one internal force field, FIG. 4 is in cross-section the arrangement in principle of a further embodiment of the apparatus wherein the counterelectrode is formed as a screen or grid, FIG. 5 is a longitudinal section of a still further embodiment of the apparatus wherein the counterelectrode is formed as an annular or ring electrode, FIG. 6 is a longitudinal section of yet another preferred embodiment with an annular counterelectrode in the form of a nozzle with a constricted cross-section at the inlet to the charging chamber or space, FIG. 7 is a variant of the apparatus shown in FIG. 6, wherein a widened portion of the charging space is connected to the inlet cross-section of the annular counterelectrode and wherein the charging space is then further constricted at the outlet side, FIG. 8 is the arrangement in principle of a further development of the embodiment shown in FIG. 7, in longitudinal section, wherein the widened charging space is constricted in the area of the tip of the charging electrode so that the constriction forms a kind of nozzle, and, FIG. 9 is a still further embodiment of the apparatus in longitudinal section, comprising a counterelectrode formed as a pipe for the transport of material particles and connected to the grounded housing of the apparatus.

Unless otherwise indicated, like or functionally equivalent parts have been allotted the same reference numbers throughout the description of the preferred embodiments.

Referring first to the preferred embodiment shown in FIG. 1, there is shown a spray gun which includes a needle-like charging electrode 1 having an inner tip or point 2 disposed within a tubular charging chamber or space 24 defined by a pipe or feed channel 12 of electrically non-conducting material which constitutes a feed channel for the material particles to be sprayed out through the spray gun. In the direction of feed of the material particles, there is provided upstream of the tip 2 of the charging electrode 1 a rounded counterelectrode 4 in the shape of a fully cylindrical central electrode rounded off at both ends in the axial centre line of the charging space 24.

The charging electrode 1 is connected to one pole of a high tension DC source 9 via a high tension cable 10 and a current-limiting resistor 11. The other pole of the DC source 9 is connected via ground to an object 5 to be coated. The counterelectrode 4 is also grounded.

The charging electrode 1 is disposed in an outwardly widening mouth of the feed channel and extends through a central, insulating guiding body 8 which latter forms an outlet diffuser 21 with the feed channel. The charging electrode projects forwardly beyond the outlet diffuser and terminates in an outer point or tip 3. The tip of the charging electrode 1 points at the object 5 to be coated and forms with the latter a force field 7 while the tip 2 pointing upstream forms a force field 6 with the rounded counterelectrode 4 arranged in the tubular charging space 24. The material particles to be sprayed out arrive along arrow 20 from a flexible plastics hose 15 connected to a metallic housing 18, including a pistol grip, of the coating apparatus in a finely dispersed condition, pass into the charging space 24 in the direction shown by the arrow 20 and flow through the force field 6 wherein the particles move in a direction opposite to that of the ion wind from the tip 2 and are thus charged.

For the efficient functioning of the force field 6 disposed within the coating apparatus the asymmetric electrode formation according to the invention is of great significance. The configuration is called "asymmetric" because the tip 2 of the charging electrode 1 is opposed to the rounded surface of the grounded counterelectrode 4. The asymmetric construction of the force field 6 alone ensures that the electric charges, ions, discharge exclusively from the region of the corona discharge of the tip 2 and in this way only similarly charged ions flow to charge the material particles.

Because of the counter-flowing ions, the coating material particles are charged in the force field 6 in a uniform and very intensive manner and then pass along the charging electrode 1 to the body 8 so as to flow through the diffuser 21 into the outer force field 7 formed between the point 3 and the object 5. Since in the force field 7 the material particles flow in the same direction as the ions, they receive a additional charge and are deposited on the object 5 to be coated, partly through their own charge and partly through the effect of the outer force field 7.

In use, as they discharge from the diffuser 21, the material particles receive a change of direction, or directional guidance, by an air stream discharged from an annular nozzle 14 radially spaced around the diffuser outlet, whereby the material particles are brought into the outer force field 7 in a favourably fine distribution. In addition, the charging space 24 is also provided with nozzles 14' to receive air to improve the distribution of the particles of the material and to intensify the mixing of the particles and the ions.

The air for these streams comes from an annular channel 22 formed between the pipe of insulating material forming the feed channel 12 and the charging space 24, and the outer wall 13 of the coating apparatus, via an air hose 19 passing from below into the hollow interior of the metallic pistol grip 18 of the housing. The air stream may be interrupted by means of a valve 17 disposed in the interior of the pistol grip 18 and adapted to be actuated by a trigger 16.

The air flowing in from the air hose 19 controls, in a well-known manner and with the aid of non-illustrated sensing and switching devices, the power source 9 as well as the transport and metering of the coating material through the pipe 15. The pistol grip 18 is preferably grounded to provide increased operator safety.

The embodiment shown in FIG. 2 has metallic charging electrodes 23 which are tear-shaped in longitudinal section and have tips opposed to the direction of flow of the material particles in charging spaces 25 bounded by insulating material. In this way several asymmetric fields are formed. The metallic electrodes 23 are not interconnected and are so formed that they are rounded off at their ends nearer the diffuser 21 while their ends nearer the counterelectrode 4 are sharp.

In each asymmetric force field 6 shown in FIG. 2, charges of the same polarity flow, and their charge is identical with those of the ions of the outer force field 7. In this way the charged material particles flowing through the force fields in a direction of movement opposed to that of the ions are intensively charged. Between the charging electrode 1 connected to the DC source 9 and the grounded counterelectrode 4 with a rounded end, the electrodes 23 are disposed one behind the other but are not electrically connected. They are charged by the electrode 1 to potentials which are of stepwise decreasing magnitude, in the sense that an overall charge equilibrium is obtained. As a result of the ionization the charges received at the front hold an equilibrium with the charges moving farther away. With this constructional form the intensity of the charge imparted to the coating material can be greatly increased.

The intensity of charging is rendered even more favourable by forming the charging spaces 25 between successive electrodes 1, 23, 23 and 4 in FIG. 2 as a series of widening and then narrowing spaces. This construction causes the particles entering into the charging spaces 25 to flow in turbulence, to be braked and therefore to be subjected more intensely to the force fields 6. The construction of the metallic electrodes 23 contributes to this, as their blunt downstream ends form flow constrictions with the surrounding tube wall 12.

Although only one charging space 25 is shown as being provided with air nozzles 14', each charging space 25 may be so provided, if desired. Apart from this, the embodiment of FIG. 2 corresponds to that of FIG. 1.

FIG. 3 shows a modification of the embodiment of FIG. 1, in which the charging electrode 1 has a tip 2 only at its upstream end, and between the central counterelectrode 4 and the charging electrode 1 the charging space 25 has a flow cross-section that first widens and then narrows back to the original flow cross-section. The downstream end of the charging electrode 1 terminates in the guiding body 8 formed of insulating material and is electrically shielded thereby.

In this way the outer force field between the electrode and the object is considerably weaker, and practically no ionization of the surrounding air takes place. Accordingly, the material particles to be coated are virtually exclusively charged in the inner force field 6 and deposit themselves on the grounded object only under the effect of their own charge.

This embodiment of the apparatus according to the invention has a particular significance for objects of awkward or bulky shape. This is because in the presence of a strong outer force field the material particles sprayed out tend to deposit preferentially on the surfaces of the object which are nearer to the spray head while the more remote surfaces of the object tend to receive hardly no coating. Accordingly, this embodiment of the apparatus according to the invention is important because it tends to provide a uniform coating even in the case of intricately shaped objects.

In the embodiment according to FIG. 4*a* counterelectrode 4*a* is formed as a metallic grid intersecting or extending across the insulating pipe or feed channel 12. Relative to the direction of flow of the material particles, the grid-like counterelectrode 4*a* is at the inlet to the charging space 25 which widens in cross-section from the grid 4*a* and then narrows again until it meets the plane of the tip or point 2 of the charging electrode 1 where it regains its original cross-section of the feed channel 12.

In the embodiment according to FIG. 5 a counterelectrode 4*b* is formed as a hollow cylindrical ring through which extends the feed channel 12 of insulating material without there being any change in flow cross-section. However, even in the embodiment according to FIG. 5, if it were so desired, the annular counterelectrode could be connected to a widened portion such as the charging space 25.

As can be seen from FIG. 6, there is here provided an annular counterelectrode 4*c* providing a flow cross-section restriction at the inlet to the charging space 25. By virtue of the higher flow velocity resulting from the flow constriction in the region of the annular counterelectrode 4*c*, the risk of the charges or ions discharged from the point 2 of the charging electrode 1 reaching the counterelectrode 4*c* without charging the material particles, and thus of being discharged without providing a useful effect, is reduced.

As can be seen from FIG. 7, a counterelectrode 4*d* forms an inlet nozzle or jet of restricted cross-section at the inlet plane of the charging space 25. The charging space continuously widens in the direction of flow from its connection to the counterelectrode 4*d* and then narrows again to the original cross-section of the feed channel 12 at the region of the tip 2 of the charging electrode 1.

By the widening of the charging space 25 the flow velocity of the material particles to be charged is reduced and in this way the probability of entraining fully the ions discharged from the tip 2 of the charging electrode 1 is increased.

In the embodiment shown in FIG. 8 the nozzle-type counterelectrode 4*d* is again used, and the flow cross-section of the feed channel 12 is, when compared with the embodiment of FIG. 7, narrowed around the tip 2 of the charging electrode 1 and then widened to regain its original flow cross-section. There results, in effect, a rounded outlet nozzle which is favourable from the point of view of flow. In this way the particles charged by the charges from the electrode 1 flow with high acceleration.

FIG. 9 shows an apparatus according to the invention which is easily constructed. In this example a pipe-like counterelectrode is designated by numeral 4*e* and is formed as a tube to constitute the inlet section of the pipe or feed channel 12 in the spray gun. The tubular counterelectrode 4*e* is connected to the grounded metal grip 18 of the apparatus. The finely dispersed material particles flow through the pipe 12. At the outlet of the counterelectrode 4*e* there is the charging space 25 which at first widens and then narrows again at the tip 2 of the charging electrode 1.

What we claim is:

1. Electrostatic spray apparatus comprising:
   - a feed conduit through which a stream of particles of coating material flow, the conduit outlet comprising a spray nozzle;
   - at least one intermediate conduit section formed at at least one enlarged charging chamber;
   - a charging electrode disposed within said conduit and having a functional end facing upstream, with respect to said particle feed conduit, and lying adjacent an end of said chamber;
   - at least one counter electrode disposed within said conduit and having an end both opposed to said functional end and lying adjacent the other end of said chamber; said electrode ends being of opposite polarities and connected to a high voltage source; and the conduit portion connected to and downstream of said chamber being smaller in flow cross-section than the upstream conduit section connected to said chamber.

2. The apparatus of claim 1 wherein said charging electrode is axially disposed within said conduit and said functional end is pointed.

3. The apparatus of claim 2 wherein said charging electrode extends beyond said nozzle outlet and terminates in a pointed end.

4. The apparatus of claim 1 wherein at least a second enlarged charging chamber is disposed spaced from and upstream of said first-recited chamber and has a counterelectrode operatively associated therewith in like manner as the first recited corresponding structure; and no second charging electrode is utilized and said counterelectrodes are operatively associated with one another.

5. The apparatus of claim 4 wherein: each counterelectrode is electrically conductive and formed obtuse at the end opposed to said charging electrode; and each counterelectrode is formed pointed at the end opposed to a counterelectrode disposed upstream thereof.

6. The apparatus of claim 1 wherein said conduit is flared at the nozzle outlet.

7. The apparatus of claim 1 wherein said counterelectrode is formed as a metallic grid extending across said conduit.

8. Apparatus as in claim 1 wherein said counterelectrode is annular and formed about a section of said conduit.

9. Apparatus as in claim 8 wherein said annular counterelectrode is formed about a constriction in said conduit.

10. Apparatus as in claim 1 wherein said conduit is disposed coaxially within means forming an annular fluid flow path terminating in an outlet located in said nozzle outlet and directing said fluid flow into the particle stream.

11. Apparatus as in claim 10 wherein said means forming the annular fluid flow path has an additional outlet means located at said charging chamber whereby said fluid flow is directed into the particle stream in said chamber.

12. Apparatus as in claim 1 wherein said feed conduit and said electrodes are disposed in a pistol-grip type metallic housing that is grounded.

13. Apparatus as in claim 1 wherein said outlet is shaped as a flow diffuser.

* * * * *